US009784211B2

(12) United States Patent
Linke

(10) Patent No.: US 9,784,211 B2
(45) Date of Patent: Oct. 10, 2017

(54) PISTON FOR AN INTERNAL COMBUSTION ENGINE

(71) Applicant: MAHLE International GmbH, Stuttgart (DE)

(72) Inventor: Timo Linke, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 93 days.

(21) Appl. No.: 14/415,251

(22) PCT Filed: Jul. 18, 2013

(86) PCT No.: PCT/DE2013/000402
§ 371 (c)(1),
(2) Date: Jan. 16, 2015

(87) PCT Pub. No.: WO2015/007256
PCT Pub. Date: Jan. 22, 2015

(65) Prior Publication Data

US 2015/0322887 A1 Nov. 12, 2015

(30) Foreign Application Priority Data

Jul. 18, 2012 (DE) ..... 10 2012 014 195

(51) Int. Cl.
*F01P 1/04* (2006.01)
*F02F 3/22* (2006.01)
(Continued)

(52) U.S. Cl.
CPC ..... *F02F 3/225* (2013.01); *F02F 3/003* (2013.01); *F02F 3/22* (2013.01); *F01M 1/08* (2013.01);
(Continued)

(58) Field of Classification Search
CPC ..... F01P 1/04; F02F 3/20; F02F 1/22; F02B 2075/025; F01M 1/08
(Continued)

(56) References Cited

U.S. PATENT DOCUMENTS 4,377,967 A 3/1983 Pelizzoni
4,986,167 A 1/1991 Stratton et al.
(Continued)

FOREIGN PATENT DOCUMENTS

CN 1745240 A 3/2006
CN 1977103 A 6/2007
(Continued)

OTHER PUBLICATIONS

International Search Report of PCT/DE2013/000402, mailed Nov. 19, 2013.
(Continued)

*Primary Examiner* — Jacob Amick
*Assistant Examiner* — Charles Brauch
(74) *Attorney, Agent, or Firm* — Collard & Roe, P.C.

(57) ABSTRACT

The present invention relates to a piston (10) for an internal combustion engine, which has a piston skirt (14) as well as a piston head (13) having a circumferential ring belt (21) and having a circumferential cooling channel (24) closed off with a closure element (26), wherein a circumferential recess (23) is formed between the piston head (13) and the piston skirt (14). According to the invention, it is provided that the closure element (26) consists of at least two subcomponents (27, 28), that each subcomponent (27, 28) has a radially oriented base plate (29) and at least one circumferential collar (31) oriented axially on the outer edge (29*a*) of the base plate (29), which collar is accommodated in at least one outer fold (34) that runs underneath the ring belt (21).

10 Claims, 1 Drawing Sheet

Figure 1:
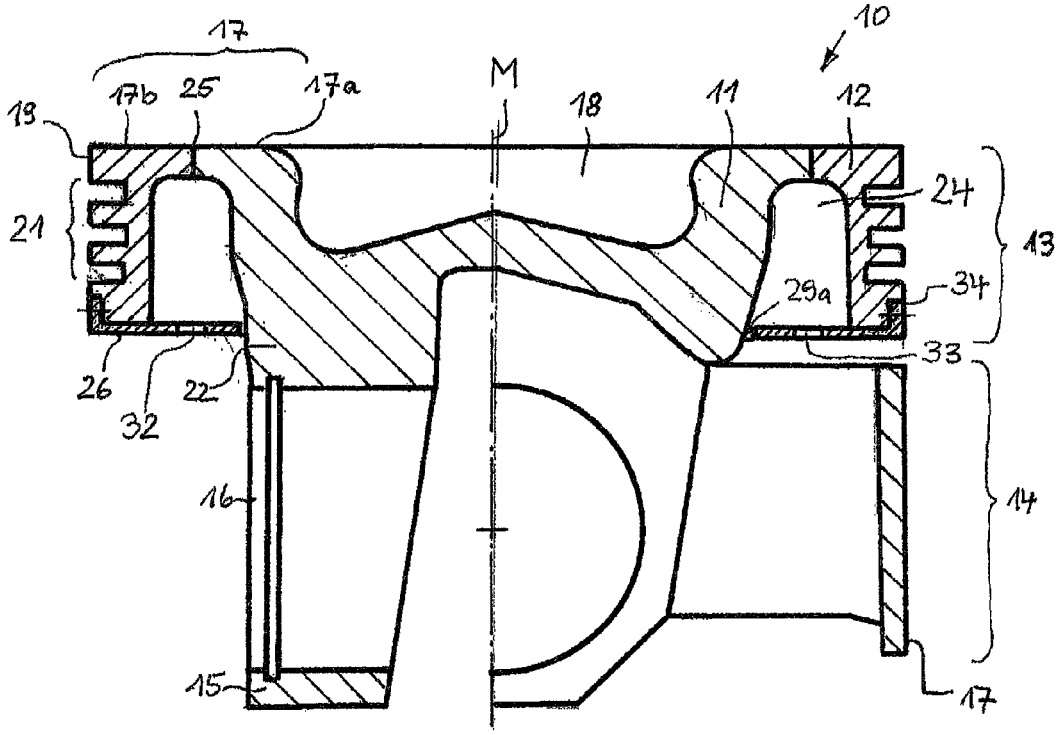

(51) Int. Cl.

| | |
|---|---|
| *F02F 3/00* | (2006.01) |
| *F02F 1/22* | (2006.01) |
| *F01M 1/08* | (2006.01) |
| *F02B 75/02* | (2006.01) |
| *F02F 3/20* | (2006.01) |

(52) U.S. Cl.
CPC ..... *F01P 1/04* (2013.01); *F02B 2075/025* (2013.01); *F02F 1/22* (2013.01); *F02F 3/20* (2013.01); *F02F 2003/0053* (2013.01); *F02F 2003/0061* (2013.01)

(58) Field of Classification Search
USPC ..... 123/41.39
See application file for complete search history.

(56) References Cited

U.S. PATENT DOCUMENTS

| | | | | |
|---|---|---|---|---|
| 5,052,280 | A | 10/1991 | Kopf et al. | |
| 5,070,768 | A | 12/1991 | Goncalves et al. | |
| 5,144,923 | A | 9/1992 | Leites et al. | |
| 5,357,920 | A | 10/1994 | Kemnitz et al. | |
| 5,546,896 | A | 8/1996 | Zaiser | |
| 5,778,533 | A | 7/1998 | Kemnitz | |
| 6,647,861 | B1 | 11/2003 | Jacobi et al. | |
| 6,763,757 | B2 | 7/2004 | Huang et al. | |
| 6,772,846 | B1 | 8/2004 | Scharp | |
| 6,957,638 | B2 * | 10/2005 | Scharp | F02F 3/22 123/193.1 |
| 7,387,100 | B2 | 6/2008 | Fiedler et al. | |
| 7,415,959 | B2 | 8/2008 | Scharp | |
| 2002/0124401 | A1 | 9/2002 | Huang et al. | |
| 2010/0107998 | A1 * | 5/2010 | Scharp | F02F 3/22 123/41.35 |

FOREIGN PATENT DOCUMENTS

| | | | |
|---|---|---|---|
| CN | 101238283 | A | 8/2008 |
| DE | 39 91 677 | T1 | 6/1991 |
| DE | 41 24 634 | A1 | 1/1993 |
| DE | 44 30 137 | A1 | 2/1996 |
| DE | 44 46 726 | A1 | 6/1996 |
| DE | 101 10 889 | C1 | 10/2002 |
| DE | 101 32 446 | A1 | 1/2003 |
| DE | 101 32 447 | A1 | 1/2003 |
| DE | 10 2004 019 010 | A1 | 11/2005 |
| DE | 10 2006 045 728 | A1 | 4/2008 |
| EP | 1 199 461 | A1 | 4/2002 |
| JP | H02-501153 | A | 4/1990 |
| JP | H06-503141 | A | 4/1994 |
| JP | H10-511756 | A | 11/1998 |
| WO | 92/10659 | A1 | 6/1992 |
| WO | 00/77377 | A2 | 12/2000 |

OTHER PUBLICATIONS

German Search Report dated May 17, 2013 in German Application No. 10 2012 014 195.5 with English translation of the relevant parts.
Chinese Office Action in CN 201380038374.6, dated Jun. 1, 2016.
Japanese Office Action in JP 2015-530291, dated Mar. 15, 2017 with English translation of relevant parts of the German comments.

* cited by examiner

PISTON FOR AN INTERNAL COMBUSTION ENGINE

CROSS REFERENCE TO RELATED APPLICATIONS

This application is the National Stage of PCT/DE2013/000402 filed on Jul. 18, 2013, which claims priority under 35 U.S.C. §119 of German Application No. 10 2012 014 195.5 filed on Jul. 18, 2012, the disclosures of which are incorporated by reference. The international application under PCT article 21(2) was not published in English.

The present invention relates to a piston for an internal combustion engine, which has a piston skirt as well as a piston head having a circumferential ring belt and having a circumferential cooling channel closed off with a closure element, wherein a circumferential recess is formed between the piston head and the piston skirt.

A piston of the stated type is known from DE 44 46 726 A1, for example, and is also referred to as a "piston having a thermally uncoupled piston skirt." Such pistons are characterized by great strength and great heat resistance due to the thermal uncoupling of piston head and piston skirt.

A closure element in the form of a two-part plate spring is known from DE 10 2004 019 010 A1, which spring has a varying, location-dependent spring force that acts radially toward the outside in the relaxed state. In the assembled state, the plate spring lies against its contact points formed in the cooling channel at a constant surface pressure, thereby preventing excess wear in this region.

The task of the present invention consists in further developing a piston of the stated type in such a manner that the cooling channel is closed in particularly simple manner.

The solution consists in that the closure element consists of at least two subcomponents, that each subcomponent has a radially oriented base plate and at least one circumferential collar oriented axially on the outer edge of the base plate, which collar is accommodated in at least one outer fold that runs underneath the ring belt.

The idea according to the invention consists in accommodating a closure element that consists of at least two subcomponents in the outer fold disposed underneath the ring belt, with precise fit. The at least two subcomponents have a very simple structure and can be produced easily. The need for setting up a spring bias is eliminated. The at least two subcomponents are attached to the piston in usual manner. Because no disruptive tensions occur, the closure element configured according to the invention is securely and permanently held on the piston.

Advantageous further developments are evident from the dependent claims.

It is practical if the at least one collar and/or the at least one base plate is attached to the piston by means of welding, gluing or soldering.

Preferably, the at least one collar is disposed flush with the outer contour of the piston head, in order to guarantee a precise fit in the cylinder in the assembled state.

It is practical if each subcomponent has precisely one continuous collar. However, the subcomponents can also have two or more collars spaced apart from one another.

It is advantageous if at least one oil entry opening and/or oil exit opening is provided in at least one base plate, in order to guarantee cooling oil circulation in the cooling channel. This at least one oil entry opening and/or oil exit opening is preferably formed in the end regions of two adjacent subcomponents. The recesses in the end regions that are required for this purpose can be formed directly during the production process of the subcomponents.

The free edge of the at least one base plate is preferably disposed at a distance from the piston. The free space between base plate and piston can then serve as an additional cooling oil exit opening.

It is practical if the closure element is configured as a sheet-metal component. It can also be configured as a spring sheet. In this case, if desired, the free edge of at least one base plate can lie against the piston with bias.

Figure 2:
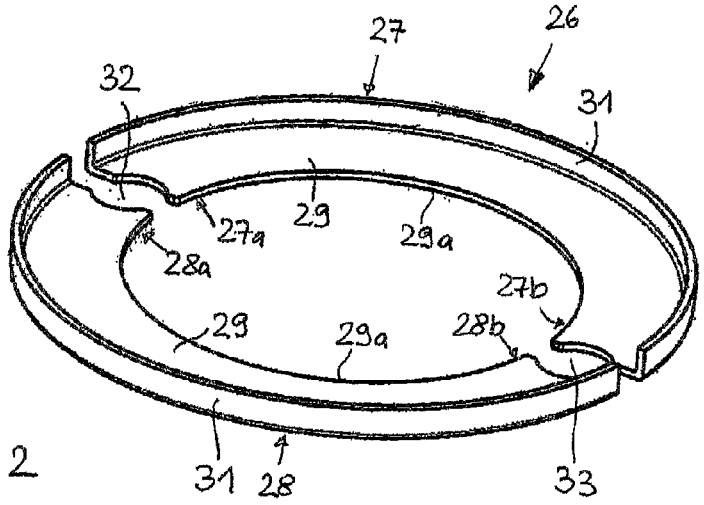

An exemplary embodiment of the present invention will be explained in greater detail below, using the attached drawings. These show, in a schematic representation, not true to scale:

FIG. 1 an exemplary embodiment of a piston according to the invention in section, whereby the right half is shown rotated by 90° relative to the left half;

FIG. 2 an enlarged perspective representation of an exemplary embodiment of a closure element.

FIG. 1 shows an exemplary embodiment of a piston 10 according to the invention. The piston 10 has a piston base body 11 and a piston ring element 12. Both components can consist of any desired metallic material that is suitable for joining of the components. The piston base body 11 and the piston ring element 12 together form the piston head 13 and the piston skirt 14 of the piston 10.

The piston base body 11 has the piston skirt 14, which is provided, in known manner, with pin bosses 15 and pin bores 16 for accommodating a piston pin (not shown), as well as with working surfaces 17. The piston base body 11 furthermore forms an inner portion 17*a* of a piston crown 17 as well as a combustion bowl 18.

The piston ring element 12 forms an outer portion 17*b* of the piston crown 17 and furthermore has a circumferential top land 19 and a circumferential ring belt 21 for accommodating piston rings (not shown).

The pin bosses 15 of the piston base body 11 are suspended on the underside of the piston head 13 by way of pin boss connections 22. The piston skirt 14 is separated from the ring belt 21 by means of a circumferential ring-shaped recess 23. Therefore the piston skirt 14 is thermally uncoupled from the piston head 13.

The piston base body 11 and the piston ring element 12 are connected with one another by means of joining, in the exemplary embodiment preferably by means of laser welding. As a result, a joining seam 25 is formed in the region of the piston crown 17, which seam runs parallel to the center axis M of the piston 10 in this exemplary embodiment.

The piston base body 11 and the piston ring element 12 together form a circumferential cooling channel 24, which is disposed between the combustion bowl 18 and the ring belt 21 and is closed off with a closure element 26.

FIG. 2 shows an enlarged perspective representation of the closure element 26 of the piston 10. In the exemplary embodiment, the closure element 26 is structured as a sheet-metal component and consists of two subcomponents 27, 28. Each subcomponent has a radially oriented base plate 29 having a free edge 29*a* and precisely one axially oriented circumferential collar 31, which is disposed on the outer edge of the base plate 29, in each instance. Recesses are provided in the end regions 27*a*, 27*b*, 28*a*, 28*b* of the subcomponents 27, 28, which recesses together form an oil entry opening or oil exit opening 32, 33, in each instance.

From FIG. 1, it can be derived that each circumferential collar 31 is accommodated in an outer fold 34, which is formed in the piston ring element 11 underneath the ring belt 21. Each collar 31 is configured flush with the outer contour of the piston ring element 11. Each subcomponent 27, 28 is attached to the piston ring element 11 in the region of its base plate 29 and/or in the region of its collar 31, by means of welding. In the exemplary embodiment, the free edge 29*a* of each base plate 29 is disposed at a distance from the piston 10.

The invention claimed is:

1. Piston (10) for an internal combustion engine, which has a piston skirt (14) as well as a piston head (13) having a circumferential ring belt (21) and having a circumferential cooling channel (24) closed off with a closure element (26), wherein a circumferential recess (23) is formed between the piston head (13) and the piston skirt (14), wherein the closure element (26) consists of at least two subcomponents (27, 28), wherein each subcomponent (27, 28) consists of a base plate (29) that is oriented horizontally relative to a vertically oriented piston center axis, and at least one circumferential collar (31) that extends parallel to the piston center axis and perpendicular to the base plate on an outermost portion of the closure element, which collar is accommodated in at least one outer fold (34) that runs underneath the ring belt (21).

2. Piston according to claim 1, wherein the at least one circumferential collar (31) and/or the at least one base plate (29) is attached to the piston (10) by means of welding, gluing or soldering.

3. Piston according to claim 1, wherein the at least one circumferential collar (31) is disposed flush with the outer contour of the piston head (13).

4. Piston according to claim 1, wherein each subcomponent (27, 28) has precisely one continuous circumferential collar (31).

5. Piston according to claim 1, wherein at least one oil entry opening and/or oil exit opening (32, 33) is provided in at least one base plate (29).

6. Piston according to claim 5, wherein the at least one oil entry opening and/or oil exit opening (32, 33) is formed in the end regions (27*a*, 27*b*; 28*a*, 28*b*) of two adjacent subcomponents (27, 28).

7. Piston according to claim 1, wherein a free edge (29*a*) of the at least one base plate (29) is disposed at a distance from the piston (10).

8. Piston according to claim 1, wherein the closure element (26) is configured as a sheet-metal component.

9. Piston according to claim 8, wherein the closure element (26) is configured as a spring sheet.

10. Piston according to claim 9, wherein a free edge (29*a*) of at least one base plate (29) lies against the piston (10) with bias.

* * * * *